United States Patent [19]

Sweeney

[11] 4,168,495

[45] Sep. 18, 1979

[54] PRE-INTRUSION DETECTION DEVICE

[75] Inventor: James S. Sweeney, Laguna Beach, Calif.

[73] Assignee: Unisen, Inc., Irvine, Calif.

[21] Appl. No.: 840,911

[22] Filed: Oct. 11, 1977

[51] Int. Cl.[2] ..... G08B 13/22

[52] U.S. Cl. ..... 340/546; 331/65; 340/562

[58] Field of Search ..... 340/562, 546; 331/65

[56] References Cited

U.S. PATENT DOCUMENTS

| | | | |
|---|---|---|---|
| 2,094,351 | 9/1937 | Draper et al. | 331/65 |
| 3,440,633 | 4/1969 | Vinding | 340/572 |
| 3,623,063 | 11/1971 | Fontaine | 340/562 |
| 3,771,152 | 11/1973 | Dettling et al. | 340/562 |
| 3,973,208 | 8/1976 | Diamond | 340/562 |

*Primary Examiner*—Glen R. Swann, III

*Attorney, Agent, or Firm*—Thomas J. Plante

[57] ABSTRACT

An intrusion detection unit comprises a compacitance having an "active" field, the coupling of which is significantly increased when an intruder comes into conductive relation with a doorknob. The unit is hung on the inside doorknob and is so arranged that the doorknob is the transmitting element of the capacitor, while a separate plate is the receiving element of the capacitor. The capacitor field is maintained actively charged by a battery driven oscillator which operates at a substantially uniform frequency and amplitude. The intrusion detector circuit is complete in itself and is not externally grounded by the intruder. The signal receiving portion of the circuit incorporates a square law amplifier, and also has means for adjusting the reference level to which the signal is compared.

15 Claims, 4 Drawing Figures

PRE-INTRUSION DETECTION DEVICE

BACKGROUND OF THE INVENTION

This invention relates to a device for providing a pre-intrusion signal, particularly of the type which warns when an intruder is trying to open a door to gain entry. It is primarily designed to be associated with a doorknob, and to detect the proximity of an intruder's hand to the doorknob. The detected signal can then sound a warning alarm, or actuate any suitable protective device.

More specifically, I have invented a simple, highly practicable, battery-operated electrical device which can be hung on the inside of the doorknob, and which is fully self-contained, i.e., it requires no electrical connection to either an electrical power source or an external ground.

Many devices of this general type have been proposed, but the problems inherent in such detection devices have not heretofore been satisfactorily solved. Such devices, as a practical matter, do not provide an adequate intrusion signal unless they are externally connected, thereby losing the benefits and convenience of a self-contained unit.

The prior art devices intended to solve the problem have fallen into two general categories: (1) "Passive" devices—which are arranged to pick up electromagnetic or electrostatic fields generated externally, and which respond to the additional antenna effect created by an intruder; or (2) "Ground Capacitance" devices—which utilize oscillator circuits, and which experience altered circuit values when an intruder establishes an external capacitance relative to an external earth ground. Of the two prior art types, the "ground capacitance" devices appear to be more numerous.

The prior art devices of the ground capacitance type are represented by the following U.S. Pat. Nos. Bagno 3,199,096; Fontaine 3,623,063; Domin et al 3,697,971; Gehman 3,706,982; Atkins 3,735,379; Guetersloh 3,829,850; Bolle et al 4,021,679; and Tanaka et al 4,030,037. The intrusion-detection systems of each of the listed patents share certain attributes. They each rely on an external ground capacitive effect which occurs when the intruder is physically coupled to the oscillator. Also they each use changes resulting from such external ground capacitive effect to alter internal circuit values, such as oscillator output levels or frequencies, thereby causing an output signal. In such systems, the human capacitance represents a capacitive loading on the oscillator.

The prior art devices of the passive type are represented by U.S. Pat. Nos. Dettling et al 3,771,152 and Geiszler et al 3,956,743. A device of this type relies on the "antenna effect" of an intruder in causing a change in the received signal from an electromagnetic or electrostatic field. The detector signal increases because the intruder constitutes, in effect, an extension of the antenna, which is receiving "passively" the pickup from the field. In other words, the device functions by detecting the change in the charge on the antenna.

Both of the types of intrusion detectors discussed above have serious functional problems. They can operate satisfactorily if they are externally connected, or grounded, e.g., if they are plugged into an available electrical system. But it is important, as a practical matter, that the detector unit be self-contained.

When such prior art detectors are self-contained, they inherently have very weak signal changes to respond to. This is true because, whether the intruder forms an antenna or a capacitor, the human effect represents a very small addition to the existing antenna or to the existing capacitance. This is particularly serious in view of the wide range of doorknobs, metallic door frames and metallic ornametation commonly associated with door openings. The change in signal level caused by the intruder is relatively small, substantially less than 5% of the total signal level, and it is very difficult to detect reliably.

Where the device is battery-operated, the reference to earth ground is substantially non-existent, and can only be described as a current leakage, thus increasing the problem of small signal change detection. In other words, the grounding required to complete the circuit, of which the intruder forms a part, exists only to the extent of leakage; and the intrusion signal is thus minimized by the high impedance of that circuit.

As discussed in several of the prior art patents, noise is a significant problem in units which function by using a change in capacitance to vary the frequency or amplitude of an oscillator. The extraneous causes of signal changes, such as temperature change, humidity change, household 60-cycle current, etc., can cause spurious detector responses. This results in part from the weakness of the detected intrusion signal, and in part from the fact that the presence of noise causes the oscillator to change frequency or amplitude.

In the light of the deficiencies in prior art devices, and after extensive experimental efforts, I have concluded that, in order to have a successful battery-operated device for detection of a human contact with, or proximity to, a doorknob, it is necessary to generate and detect a strong signal by relying on a ground system within the detection instrument itself, thereby avoiding the necessity of working with a very small signal limited to a leakage path to earth ground.

SUMMARY OF THE INVENTION

To obtain the result just discussed, I have invented an intrusion detector incorporating a fundamentally different concept. A capacitance effect is used to detect intrusion but the capacitor is complete within the self-contained circuit of the detector.

The detector circuit includes a capacitor formed by a transmitting element and a cooperating receiving element, the transmitting element being driven by a suitable oscillator, which maintains a stable frequency and amplitude. One of the capacitor elements, preferably the transmitting element, is electrically in contact with the doorknob, so that an intruder's hand on or near the doorknob significantly increases the coupling of the capacitor. This results in the transfer of a substantially increased signal to the capacitor receiving element, which causes actuation of a protective device, such as an alarm.

The effect of the intruder's touching the doorknob is to enlarge the size of the transmitting element and/or to decrease the distance between the transmitting and receiving elements of the capacitor. If the transmitting and receiving elements are spaced apart sufficiently, the normal capacity between them is low and generates a weak electrostatic field. This field is substantially increased when an intruder touches the doorknob, causing the signal change to be generated which may be in the neighborhood of 20% of the original signal, as compared to a signal change of, say, 2% in the prior art devices.

DETAILED DESCRIPTION OF PREFERRED EMBODIMENT

Figure 1:
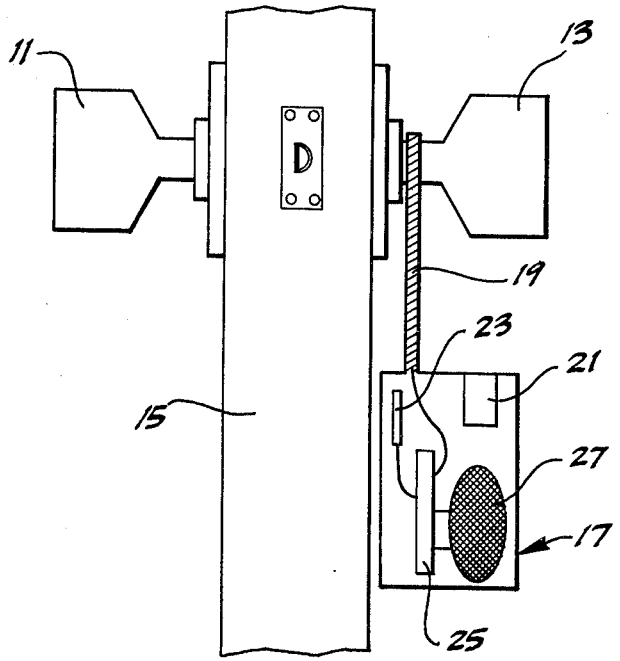
FIG. 1 is an elevation view, partly in cross-section, showing my intrusion detecting unit mounted on a doorknob.

In FIG. 1, a doorknob having an outer knob 11 and an inner knob 13 is shown extending through a door 15. Hanging from the inner knob 13 is a self-contained battery-operated intrusion detector unit 17. The unit 17 is suspended from the inner knob by a metallic chain 19, which constitutes a conductor between the circuitry of the unit and the metallic doorknob. Within the unit 17 are a battery 21, a capacitive receiving element 23, a PC board and electronic assembly 25, and an alarm 27.

As will be discussed in greater detail later, a fundamental aspect of this intrusion detector unit is the reliance on an internal capacitance, which is charged by an oscillator to create an electrostatic field, and which is caused to develop a significant signal change when an intruder contacts, or comes into proximity with, one element of the capacitor.

The two elements of the capacitor are the doorknob 11–13 and the plate-like metallic element 23. Although either of the two capacitor elements could constitute the transmitter, with the other functioning as the receiver, I have found it convenient to use the doorknob as the transmitting element of the capacitor and the element 23 in unit 17 as the receiving element of the capacitor. The transmitting and receiving elements could also be variously described as conductors, as capacitor plates, as antennas, or as transmitting and receiving electrodes.

Figure 2:
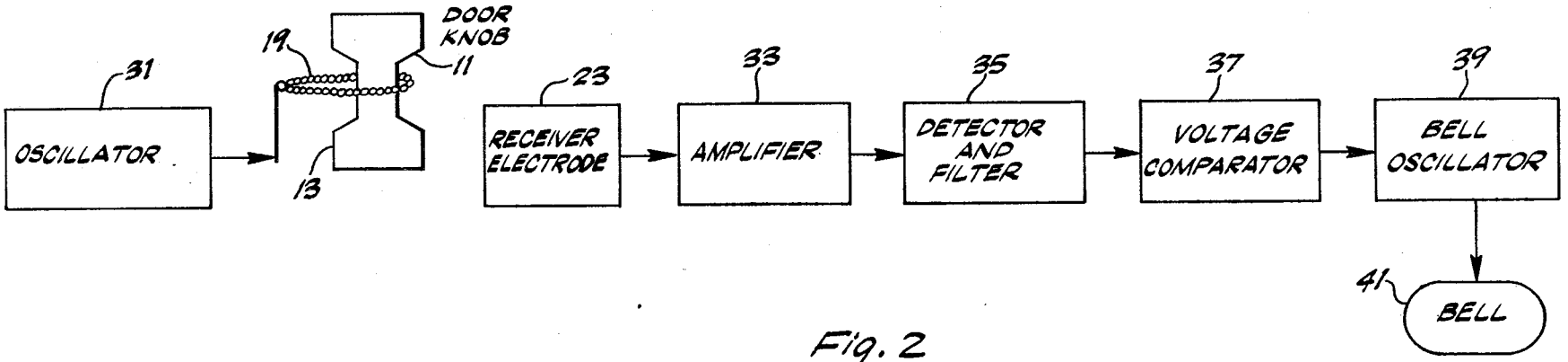
FIG. 2 is a block diagram showing the components of the electrical circuit of the intrusion detecting unit.

FIG. 2 shows the basic circuit components. An oscillator 31, which is powered by battery 21, is electrically in contact with the doorknob 11-13 via metallic chain 19. The oscillator 31 "drives" the doorknob as the transmitting element of the capacitor, thereby generating an electric field between the doorknob and the receiving element 23. The receiving element 23 of the capacitor responds to the strength of the electrostatic field, or capacitance, between itself and the doorknob.

The field signal from receiving element 23 is fed to an amplifier 33 which sends the amplified signal to a detector-and-filter 35, which yields a DC signal proportional to the incoming signal. A voltage comparator 37 compares the incoming signal with a reference level, and provides an OFF/ON signal which triggers a bell oscillator 39 when an intruder's presence is detected. Triggering of the bell oscillator 39 causes an alarm 41 to sound, and to continue sounding, as long as, and whenever, an intruder is touching or almost touching the doorknob.

Figure 3:
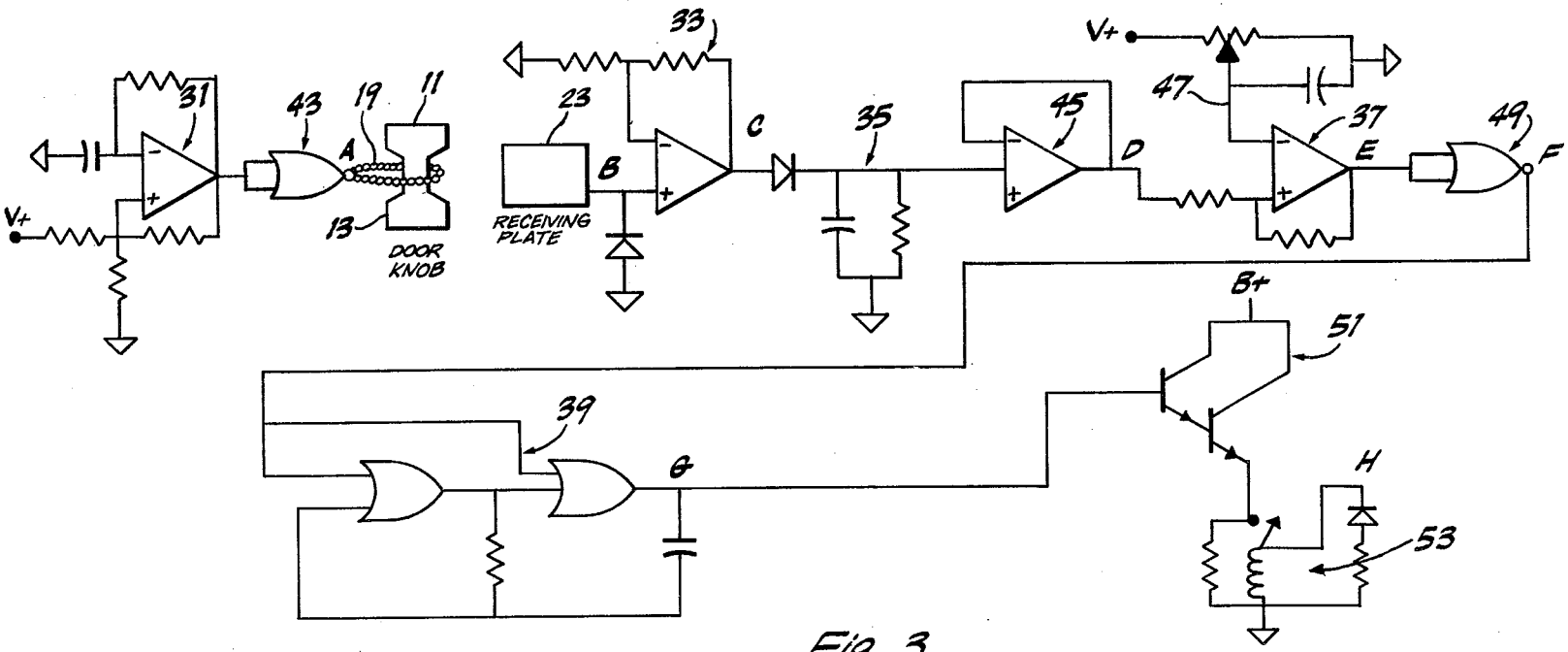
FIG. 3 is a schematic diagram showing the electrical circuit in greater detail.

FIG. 3 shows diagrammatically the details of the circuit. The oscillator 31 is preferably a square wave oscillator because the high level of harmonic signals thus generated will constitute a stronger signal and will be received and detected more easily. The oscillator 31 is shown as an operational amplifier configured as a square wave oscillator, and buffered by an inverter 43. This buffering causes the oscillator to provide a consistent signal, not affected in either frequency or amplitude by what occurs in the subsequent circuitry. This aspect is directly contra to most prior art devices, which rely on changes in the frequency and/or amplitude of the oscillator to trigger the intrusion warning. The frequency of the oscillator 31 should be selected to minimize noise interference, such as 60-cycle noise.

The signal from the buffered oscillator 31 is fed by chain 19 to doorknob 11–13, where it develops an electrostatic field between the doorknob, as the transmitting element, and the receiving element 23. The resulting signal from element 23 is fed to an operational amplifier 33 configured as a DC amplifier, which is preferably a square law amplifier in order to enhance discriminability. With a square law amplifier, the change in received signal is augmented as a function of $X^2$. For a signal difference of a ratio of 2/1, square law amplification yields a ratio of 4/1, thus providing a substantially greater signal change than could be obtained by linear amplification and detection. This is accomplished without additional power drain.

The signal from amplifier 33 is then rectified and filtered by detector filter 35 and isolated by an operational amplifier 45 configure as a voltage follower. The signal then is fed to voltage comparator 37, where it is compared with a reference signal 47. The reference signal 47 is variable so that it can be manually adjusted to provide optimum functioning of the intrusion detecting device.

When an intruder touches the doorknob 11–13, the coupling between the doorknob transmitting element and the receiving element 23 is increased, thereby increasing the signal levels at the amplifier 33, detector-filter 35, and buffer 45. Thus the comparator 37 is driven high an an inverter 49 is driven low, which starts operation of the bell oscillator 39. The bell oscillator 39 drives a Darlington pair 51 high and low in alternating sequence. An alarm 53 in the emitter circuit of the Darlington pair is activated in an alternating sequence.

Figure 4:
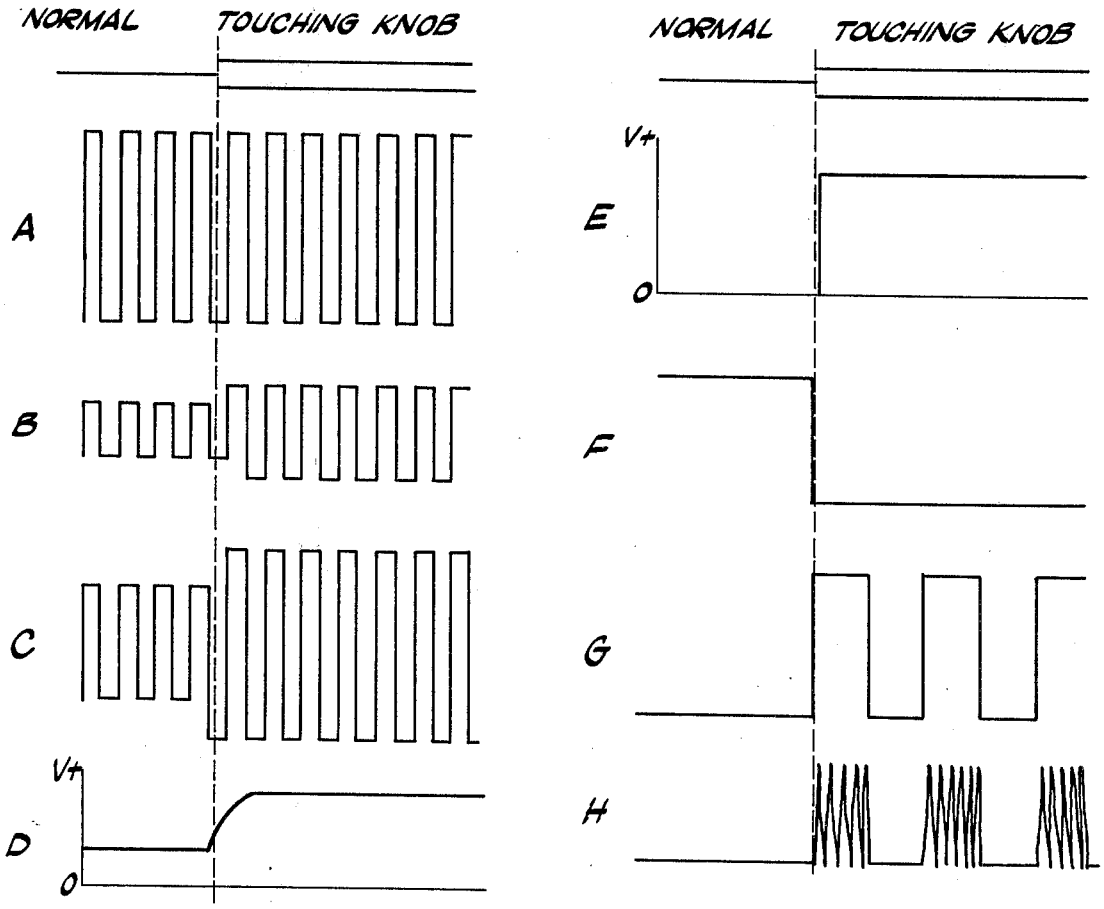
FIGS. 4A–4H are graphic representations of the electrical signals at various stages in the circuit of the preceeding figures.

FIG. 4 shows graphically the stages in the signal generation of the intrusion detector device. The left side of the figure represents the normal signal level and the right side of the figure represents the signal level when a person is touching the doorknob. Line A in the figure shows the square wave signal generated by oscillator 31, which remains constant in frequency and amplitude.

Line B represents the signal received by the receiving element 23, which responds to the electrostatic field between it and the transmitting element, doorknob 11–13. The received signal amplitude B is dependent on the distance apart and on the relative size of the transmitting and receiving elements. When the doorknob is touched, the received signal is increased as shown.

Line C represents the amplified signal from amplifier 33; and Line D represents the rectified and detected signal from detector-filter 35. The resulting signal drives the voltage comparator 37. When the rectified signal exceeds the variable (adjustable) reference level signal 47, the signal of comparator 37 goes "high," as represented on Line E; and the signal from inverter 49 goes "low," as represented on Line F. This starts the bell oscillator 39, which produces an alternating signal, as shown on Line G. This alternating signal is fed to the Darlington pair 51, which drives the alarm, as represented on Line H.

The operation of my intrusion detecting device is doubtless abundantly clear at this point, but a brief recapitulation is in order, coupled with a summary of the primary features and advantages.

The battery, oscillator, and capacitor (which includes the doorknob and the metallic receiving element) are included in a self-contained, complete-in-itself circuit, which is not grounded externally at any time. The oscillator drives the transmitting element (the doorknob) of the capacitor, thereby creating and maintaining an "active" electrostatic field between it and the receiving element. The power requirements are small because current is needed only to charge the capacitor. The oscillator output is maintained constant in frequency and amplitude, thereby minimizing noise problems which tend to result if the oscillator signal is not coherent.

The signal received by the receiving element of the capacitor is amplified and detected downstream. When an intruder reaches for the doorknob, the coupling, or capacitance, between the transmitting and receiving elements of the capacitor is very significantly increased, because the intruder's body enlarges the size of the transmitting element and/or decreases the distance between the transmitting and receiving elements. This relatively large increase in coupling in the capacitor causes an easily detectable change in the received signal, which is amplified, detected, and used to trigger an indication of the intruder's presence. The sensitivity of the alarm is adjustable by the user, who can vary the reference signal level by moving a manual control element.

The coupling effect of the intruder on the capacitor directly triggers the alarm without affecting the oscillator. The receiving element of the capacitor "sees" the change in signal amplitude due to the coupling effect. The normal coupling of the transmitting and receiving elements, when an intruder is not present, could be characterized as a "loose" coupling. The intruder causes this coupling to "tighten up," and this change directly triggers the alarm.

It is my view, based on the developmental work in connection with this invention, that the herein described device is the only practicable means of providing a doorknob intrusion alarm, if the device must be battery driven and if it must be isolated from an external grounding field. This results primarily from the very substantial increase in the signal change caused by the intruder's presence; and this in turn is due to the functional difference between devices in which the intruder is part of an external, high resistance grounding system and the present device, in which the intruder increases the capacitive coupling in an internally-grounded circuit. Another benefit results from the noise avoidance which is permitted by the use of a stable oscillator, the values of which are not altered to activate the intrusion detector. Since the transmitted and received signals are coherent in phase and frequency, external noise has an insignificant effect.

The following claims are intended not only to cover the specific embodiments disclosed, but also to cover the inventive concepts explained herein with the maximum breadth and comprehensiveness permitted by the prior art.

What is claimed is:

1. A self-contained intrusion detector unit comprising:

means for generating alternating electrical energy powered by a source within the detector unit;

means driven by said generating means for transmitting into an electrostatic field;

means capacitively coupled to said transmitting means for receiving electrical energy from said electrostatic field;

the capacitive coupling effect between said transmitting means and said receiving means being altered by the presence of an intruder in proximity thereto; and means responsive to a change in the level of the received energy due to such alteration of the capacitive coupling effect to provide an intrusion signal.

2. The intrusion detector of claim 1 which also comprises means for adjusting the sensitivity of the intrusion signal providing means to alteration of the capacitive coupling effect.

3. The intrusion detector of claim 1 wherein the presence of an intruder alters the capacitive coupling effect between the transmitting means and the receiving means without coupling either of said means to earth ground.

4. An intrusion sensing electrical circuit comprising:

means for providing an electric field comprising transmitting and receiving elements;

means for driving the transmitting element to maintain an active electric field;

the effect of the electric field on the receiving element being increased when an intruder comes into electrical conducting relation with one of said elements; and means for sensing such increased effect in order to detect the presence of an intruder.

5. The intrusion sensing circuit of claim 4 wherein there is no external grounding of the circuit even when an intruder is present.

6. The intrusion sensing circuit of claim 4 wherein the transmitting element includes a doorknob.

7. The intrusion sensing circuit of claim 4 wherein the driving means is an oscillator which operates at a substantially uniform frequency and amplitude.

8. That method of detecting the proximity of an intruder to a doorknob which comprises:

establishing and maintaining an electrostatic field between a transmitter element and a receiver element in a self-contained circuit, one of which elements is in conductive relation to the doorknob;

receiving a signal change from said field when an intruder is in conductive relation with the doorknob; and converting said signal change into an indication of the intruder's presence.

9. The method of claim 8 wherein the coupling between the transmitter and receiver elements is increased whenever an intruder is in conductive relation with the doorknob.

10. A complete-in-itself intrusion detecting device designed to be suspended from an inside doorknob comprising:

a metallic transmitting element which constitutes part of an active capacitance, and which includes the doorknob;

a battery powered continuously-transmitting oscillator in conductive relation with the transmitting element and arranged to charge the electrostatic field of the capacitance;

a metallic receiving element which constitutes part of the active capacitance and which is spaced sufficiently from the transmitting element to provide normally a weak although active electrostatic field;

the capacitive coupling and signal level between said transmitting element and said receiving element being increased significantly by an intruder's coming into conductive relationship with said doorknob;

signal-receiving means for amplifying and detecting the signal level received by said receiving element; and intrusion-indicating means responsive to the signal level from the signal-receiving means to provide an indication of intrusion when said signal increases to a level higher than a reference signal.

11. The intrusion detecting device of claim 10 wherein the oscillator is buffered from the capacitance to insure substantial uniformity in the frequency and amplitude of its output.

12. The intrusion detecting device of claim 10 wherein the presence of an intruder changes the signal level without causing a coupling of the intrusion detecting device to earth ground.

13. The intrusion detecting device of claim 10 wherein the signal-receiving means includes a square law amplifier to provide signal difference augmentation without power drain.

14. The intrusion detecting device of claim 10 wherein the intrusion-indicating means includes means for adjusting the voltage level of the reference signal, thereby varying the sensitivity of the device.

15. An earth-ground-isolated intrusion detection unit comprising:

a transmitting circuit which provides a stable, essentially unchanging alternating signal to the transmitter portion of a capacitor; and a receiving circuit which includes the receiving portion of said capacitor and which provides an output signal, the energy level of which is increased by the presence of an intruder in the vicinity of the capacitor, without affecting the transmitting circuit.

* * * * *